US006309292B1

(12) United States Patent
Montabaur et al.

(10) Patent No.: US 6,309,292 B1
(45) Date of Patent: Oct. 30, 2001

(54) ROTARY TOOL FOR SURFACE TREATMENT

(75) Inventors: Werner Montabaur, Königswinter; Detlef Thomas, Dattenberg, both of (DE)

(73) Assignee: Monti-Werkzeuge GmbH, Bonn (DE)

( * ) Notice: Subject to any disclaimer, the term of this patent is extended or adjusted under 35 U.S.C. 154(b) by 0 days.

(21) Appl. No.: 09/407,026

(22) Filed: Sep. 28, 1999

(30) Foreign Application Priority Data

Oct. 1, 1998 (DE) ..... 198 45 166

(51) Int. Cl.[7] ..... B23F 21/03
(52) U.S. Cl. ..... 451/542; 451/541; 451/548
(58) Field of Search ..... 451/542, 293, 451/206.4, 207, 168, 266, 397, 395, 330, 331, 354, 540, 541, 548; 125/15

(56) References Cited

U.S. PATENT DOCUMENTS 1,507,836 * 9/1924 King ..... 451/542
2,115,897 * 5/1938 Wooddell et al. ..... 451/542
3,641,717 * 2/1972 Neefe ..... 451/542
3,653,857 * 4/1972 Field ..... 451/356
4,245,438 * 1/1981 Van Buren, Jr. ..... 451/358
4,554,765 * 11/1985 Grimes et al. ..... 451/358

FOREIGN PATENT DOCUMENTS 43 26 793 9/1994 (DE) .
0 158 200 10/1985 (EP) .

* cited by examiner

*Primary Examiner*—Derris H. Banks
*Assistant Examiner*—Lee Wilson
(74) *Attorney, Agent, or Firm*—Herbert Dubno

(57) ABSTRACT

A rotary tool for the erasure-type abrading of adhesive residues and foil, in particular, from lacquered metal surfaces has an outer tooth crown of rubber or an elastomeric synthetic resin, the teeth being bendable. The tooth disk is mounted on a disk-shaped holder which is rotatably driven and is coupled to the latter by an inner crown.

11 Claims, 5 Drawing Sheets

ROTARY TOOL FOR SURFACE TREATMENT

FIELD OF THE INVENTION

Our present invention relates to a rotary tool for surface treatment and, more particularly, to a rotary tool for removing material from a surface, especially without adversely affecting other surface properties.

BACKGROUND OF THE INVENTION

Rotary tools for surface treatment have in the past comprised an annular disk of an elastic material, frequently referred to as a wheel, for the removal of adhesive residues and adhering plastic foils from metal surfaces. The wheel or disk mounted in a hand-held apparatus including a pneumatic or electric motor, was pressed against the article whose surface was to be treated so that the adhesive residue and foil, for example decorative strips adhesively bonded to the metal surface, advertising material or labels of synthetic resin foils, could be abraded away.

Frequently it is important that such substances and materials be removed without detriment to the surface finish of the metal body and especially to a lacquer coating which may be applied thereto. That is the case, for instance, for the removal of such residues and materials from automobile bodies.

Other rotary tools have been used for a variety of surface treatments and include annular disks of cylindrical, conical or other round shapes and have also been composed at least in part of a yieldable material such as rubber or a rubber-like synthetic resin.

A common problem with the known rotary tools is that they can be operated only at relatively slow speeds, for example 1500 RPM. Such speeds are unsatisfactory since they make the use of the tool time-consuming and, consequently, expensive. The prior art rotary tools utilized for the purposes described tend to become unround readily and, because they are relatively massive bodies, cannot resume their original configurations after deformations and tend often to be residually deformed.

Another problem arising with such prior art tools is the high heat development in use. The working surface may be subjected to excessively high temperatures and can be damaged. Furthermore, the surfaces tend to pick up flakes of lacquer, adhesive residues and the like when the tool is used to remove such residues from lacquered surfaces and these must be removed if continued use of the tools is desirable.

OBJECTS OF THE INVENTION

It is therefore the principal object of the present invention to provide an improved rotary tool for the purposes described which will be free from the drawbacks of the earlier tools used for these purposes.

More particularly, it is an object of the invention to provide a rotary tool which can be operated at extremely high rotary speeds, which maintains its roundness and hence the precision of operation desired, without damaging the surface to be treated or the active surface of the tool so that the overall operating efficiency is increased.

SUMMARY OF THE INVENTION

These objects are attained, in accordance with the invention in a rotary tool for the removal of adhesive residues, synthetic resin foil and the like from the surface of an article, especially lacquered metal surfaces like the surface of an automobile, without detriment to that surface. The tool can comprise:

an annular disk of an elastomeric material selected from the group which consists of rubber and rubber-like synthetic resins having an outer crown and an inner crown, the outer crown having an annular array of outwardly projecting elastically bendable teeth adapted to abrade material from the surface, the inner crown having a plurality of inwardly projecting formations; and a rotatable disk holder engaging the formations for rotatably entraining the disk.

Thus the tool of the invention has as its basis an annular disk or disk-shaped body of an elastomer, namely, rubber or a rubber-like synthetic resin and which is formed unitarily with both an outer crown and an inner crown.

The outer crown is formed by a circumferential array of equispaced teeth which are elastically bendable and extend outwardly from the disk. This tooth crown is thus formed with interstices between the teeth and the teeth can have outwardly converging flanks so that the interstices widen outwardly as well. The inner crown can be provided with inwardly extending formations and serves for connection of the disk to a rotatably-driven disk holder. The latter may be composed of a pair of disk-shaped members which have axially-extending projections engaging in the formations from opposite sides and thus can together form a socket or passage for the drive shaft.

The result is a tool which, because of the bendability of the individual teeth, ensures an especially clean removal of adhesive residues and foil from the surface of the metal object, even when the tool is rotated at high speeds which can amount to, for example, 3000 RPM and more.

Surprisingly, the roundness of the tool is maintained, presumably because the teeth spring back to their original positions more easily than the restoration of the deformation of a massive annular body utilized for a similar purpose. The tool of the invention has been found to operate with a significantly higher efficiency than conventional tools and to have a significantly higher useful life. This may be due at least in part to the fact that the pressure applied by the teeth and to the teeth during the process may be significantly lower than the pressure at the periphery of a conventional, continuous tool for removal of adhesive residues and synthetic resin foil from lacquered metal surfaces at the same rates. There is a surprising air effect with the tool of the invention which is due to the presence of the gaps between the teeth and, especially at high speeds ensures cooling and/or the reduction of friction heat generation. There is, as a consequence, reduced danger of damage to the tool and to the treated surface. Indeed, the development of dangerously high temperatures at the tool can be entirely excluded.

According to a feature of the invention, with independent inventive significance, the abrading or erasing effect of the tool can be increased by providing at least in the peripheral sides of the two surfaces of the abrading teeth, abrasive particles which can be embedded in these surfaces or the teeth themselves or which can be applied by wetting the surfaces with an emulsion containing these particles.

The abrasive or grinding particles can be embedded throughout the teeth or throughout the outer crown and can also be embedded or stored in the interstices of the inner crown and the entire disk body.

According to another feature of the invention the abrasive or grinding particles are comprised of corundum, silicon carbide, boron carbide, boron nitride or diamond. The particle size can be between extra fine and very coarse, these terms being used in the sense that they are used for the grit of sandpaper, emery cloth and the like An extra fine particle size of the abrasive particles or wetting emulsion containing the grinding particles can be selected for the removal of adhesive residues and foil from lacquered metal surfaces or other metal surfaces which are to remain unaffected by the treatment. Medium fine abrasive particles or particles of average particle size within the range described can be used when it is desirable to remove a lacquer from a lacquered metal surface and more coarse and up to very coarse abrasive particles can be used for descaling and rust removal of the metal or steel surfaces. The grinding emulsion can be used with or without the embedding of abrasive particles as described and the choice of the abrasive particles used, the nature of the grinding emulsion and the particle sizes will depend upon the surface treatment desired.

The teeth have flanks which converge outwardly and preferably peripheral abrasive or working surfaces which conform to circular arcs. A frustoconical tooth configuration is possible in accordance with the invention.

The formations provided along the inner periphery and forming the inner crown, preferably are angularly equispaced, e.g. spaced apart by 120°, and can include axially-extending passages or grooves into which ribs can be inserted. The holder then may comprise a pair of star-shaped disks with axial ribs which can be inserted into these passages or grooves from opposite sides and which together form the rotatably-driven disk holder with its central socket or passage for receiving the drive shaft. With this configuration, the air cushion effect is surprisingly generated which at high rotational speeds tends to lift the outer crown uniformly but slightly from the disk holder so that, for example, between the outer crown and the disk holder, without full separation of the formations and the ribs, a substantially annular gap is formed. This gap between the disk and the disk holder can increase the ventilation of the teeth and the cooling effect.

This is especially the case when the inner crown has depressions or recesses on both of its opposite axial sides to receive the star-shaped disks such that the outer surfaces of the star-shaped disks lie flush with the outer flanks of the outer crown and the outer crown will lie uniformly against the star-shaped disks. To improve the ventilation effect still further, openings can be provided in the star-shaped disks of the holder and can extend in the peripheral direction and can be elongated in the peripheral direction.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
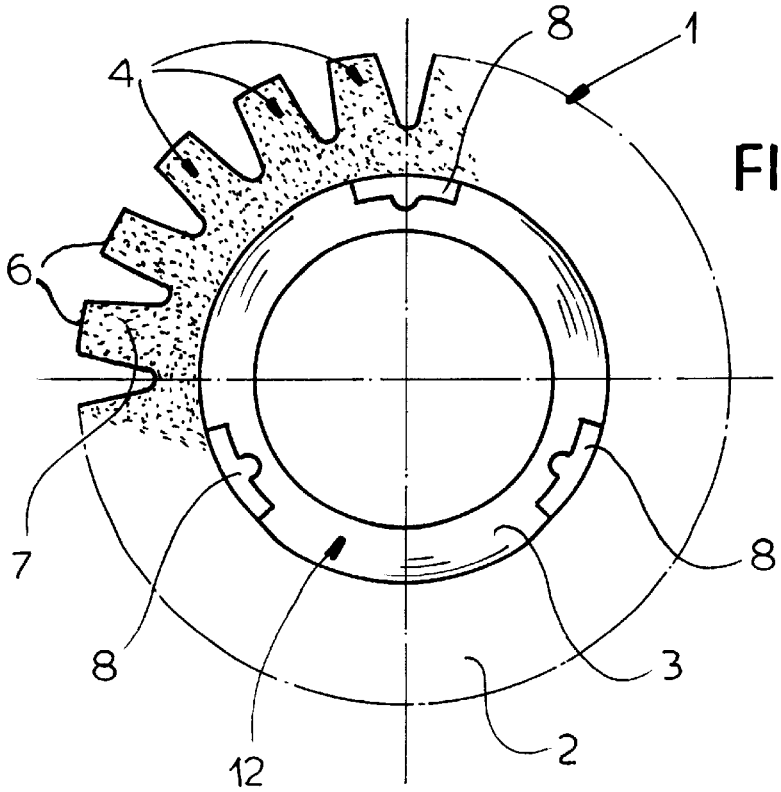
FIG. 1 is an elevational view of an annular working disk of the tool of the invention.

In the drawing we have shown a rotatable tool which comprises an annular tooth disk of rubber or a rubber-like synthetic resin which can be used for the surface treatment of a metal surface, for example, the surface of an automobile body. The tooth disk 1 has an outer crown 2 and an inner crown 3. The outer crown is formed as a tooth crown with elastically-bendable abrading teeth 4 while the inner crown 3 serves to connect the tooth disk 1 to a rotatably-driven disk holder 5.

At least in the peripheral surfaces 6 of the teeth 4, abrasive particles 7 are embedded or the porous tooth body can be wetted with a grinding emulsion containing abrasive particles. In the illustrated embodiment, the abrasive particles 7 are embedded throughout the disk 1 and thus at least in the entire outer crown 2 but also possibly in the inner crown. The abrasive particles are here composed of corundum and have a relatively fine particle size.

Figure 7:
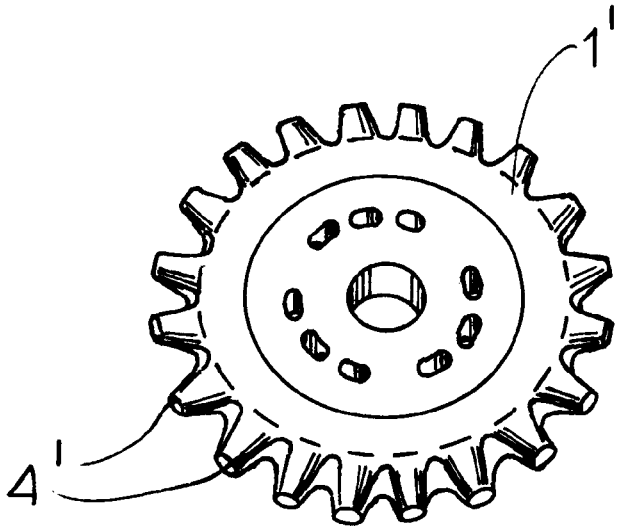
FIG. 7 is a somewhat perspective view of another tool according to the invention.

The teeth 4 have convergent flanks 4*a*, 4*b* and define interstices 4*c* between them, the interstices widening outwardly. The outer surfaces 6 which are the active surfaces, lie along circular arcs. As can be seen in the teeth 4' of the disk 1' in FIG. 7, the teeth can be of frustoconical configuration. The inner crown 3 has inwardly-extending formations 8 angularly equispaced, for example, at 120° and advantageously in the form of axially-extending passages 8 adapted to receive axially-extending ribs 9 of a pair of star-shaped disks 10 which together form a disk holder and which are inserted from opposite axial sides into the member 1. The axis has been shown at A in FIGS. 3 and 4.

The holder 5 has a socket 11 for receiving a drive shaft 11*a* of an apparatus 20 for rotating the tool.

Figure 2:
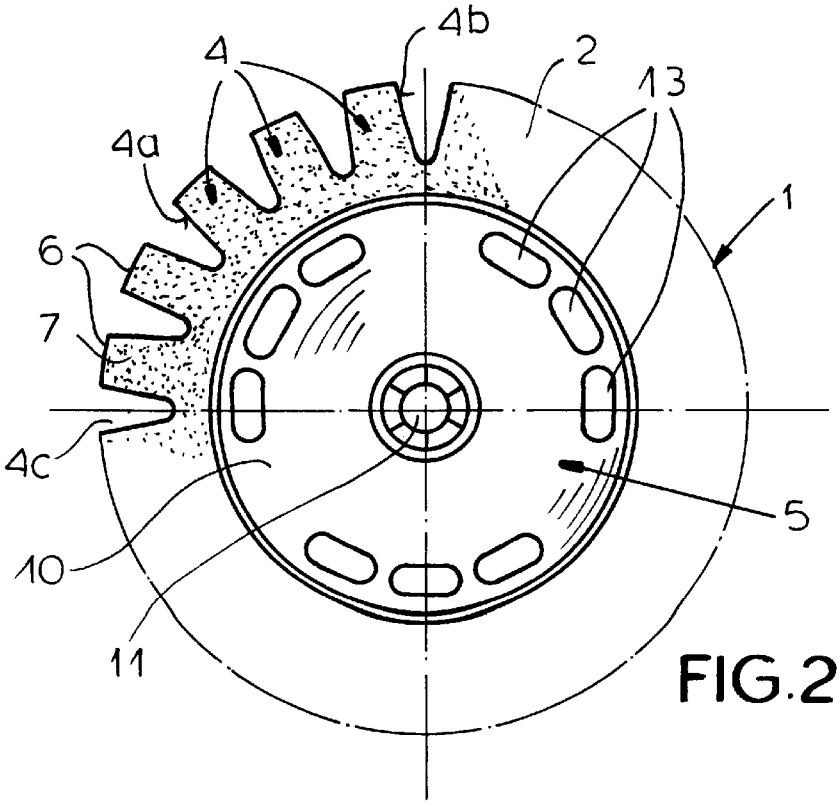
FIG. 2 shows the tooth disk mounted on the holder in a view similar to FIG. 1.

The inner crown 3 has recesses 12 on opposite axial sides (FIG. 4) to receive the disks 10 so that the outer surfaces of the latter are flush with the outer flanks 2*a* and 2*b* of the crown 2. The disks 10 have openings 13 which are spaced apart in the peripheral direction and preferably are peripherally elongated (FIG. 2) to improve the ventilation of the tool. The apparatus 20 can include a pneumatic motor 21 connected to a compressed air source by a fitting 22 and forming a handle. The body 23 can contain a transmission driving the shaft 11*a* from the pneumatic motor 21 and carrying a further handle 24 whereby the surfaces 6 can be pressed against a surface to be subject to the erasure-type abrading. The shield 25 can protect the user from flakes thrown off by the apparatus.

Figure 6:
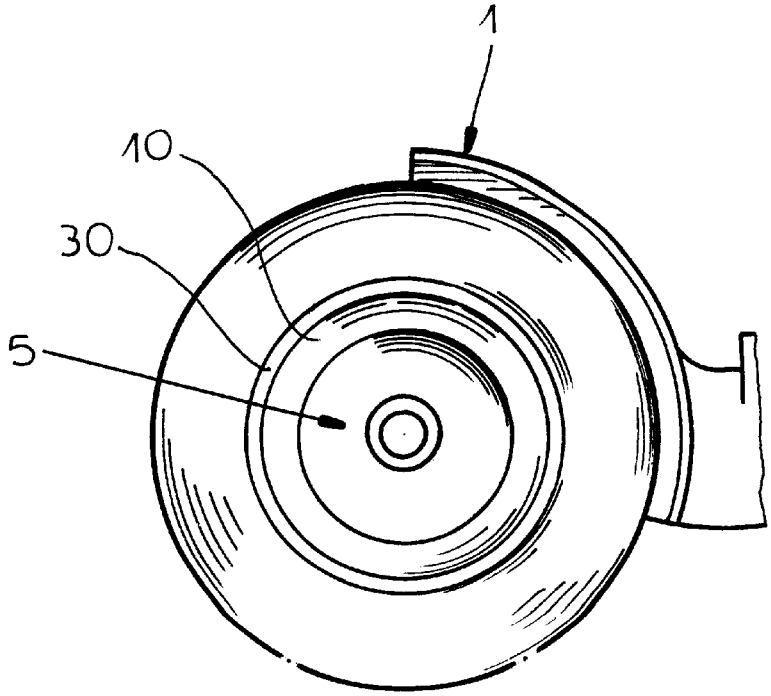
FIG. 6 is an illustration of the rotating tool showing the formation of an annular gap between the disk holder and the tooth disk.

As can be seen from FIG. 6, when the tool is spinning, an annular gap 30 can form between the outer crown and the holder 5.

Figure 3:
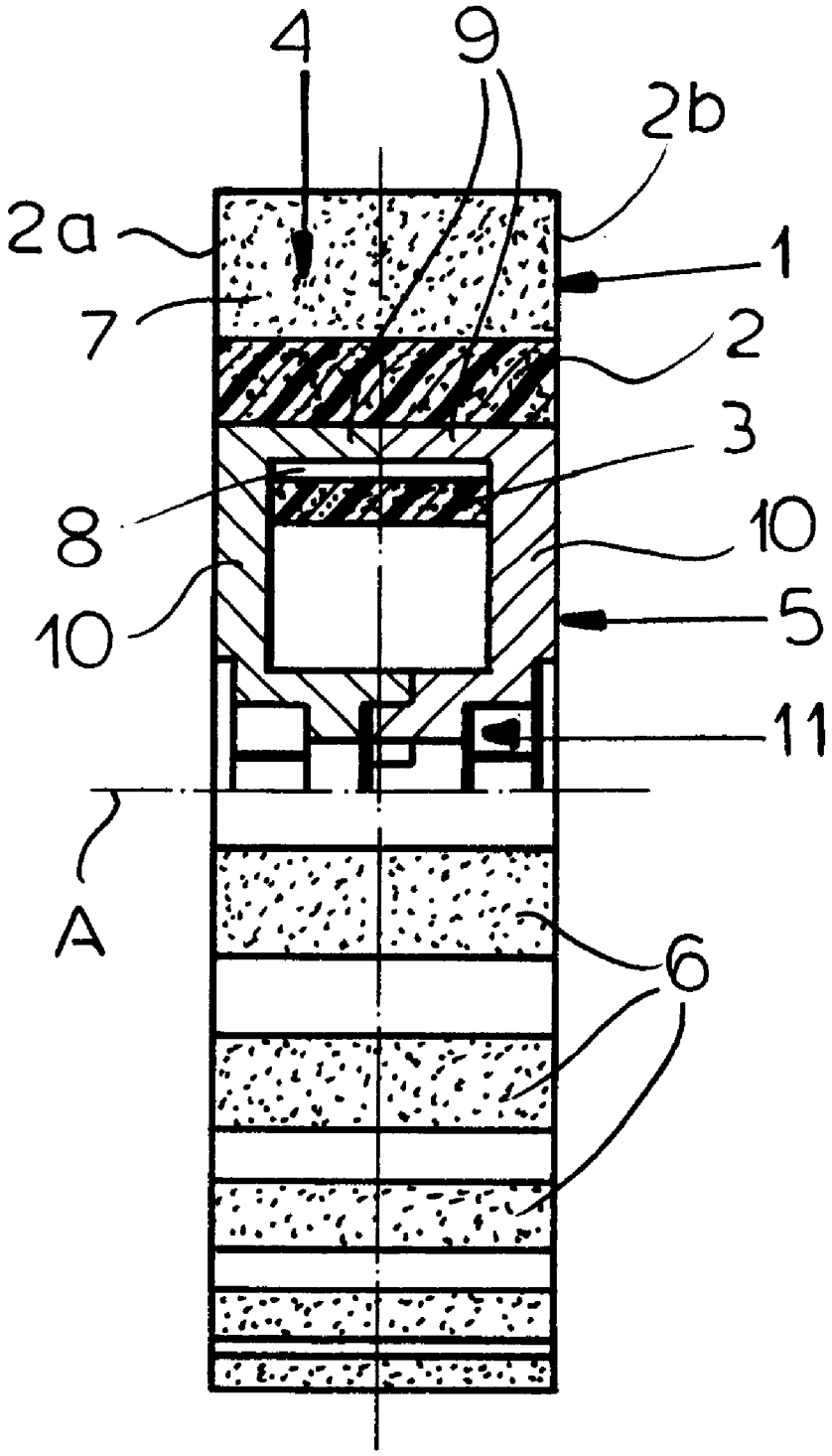
FIG. 3 is a partial section through the tooth disk of FIG. 1.
Figure 4:
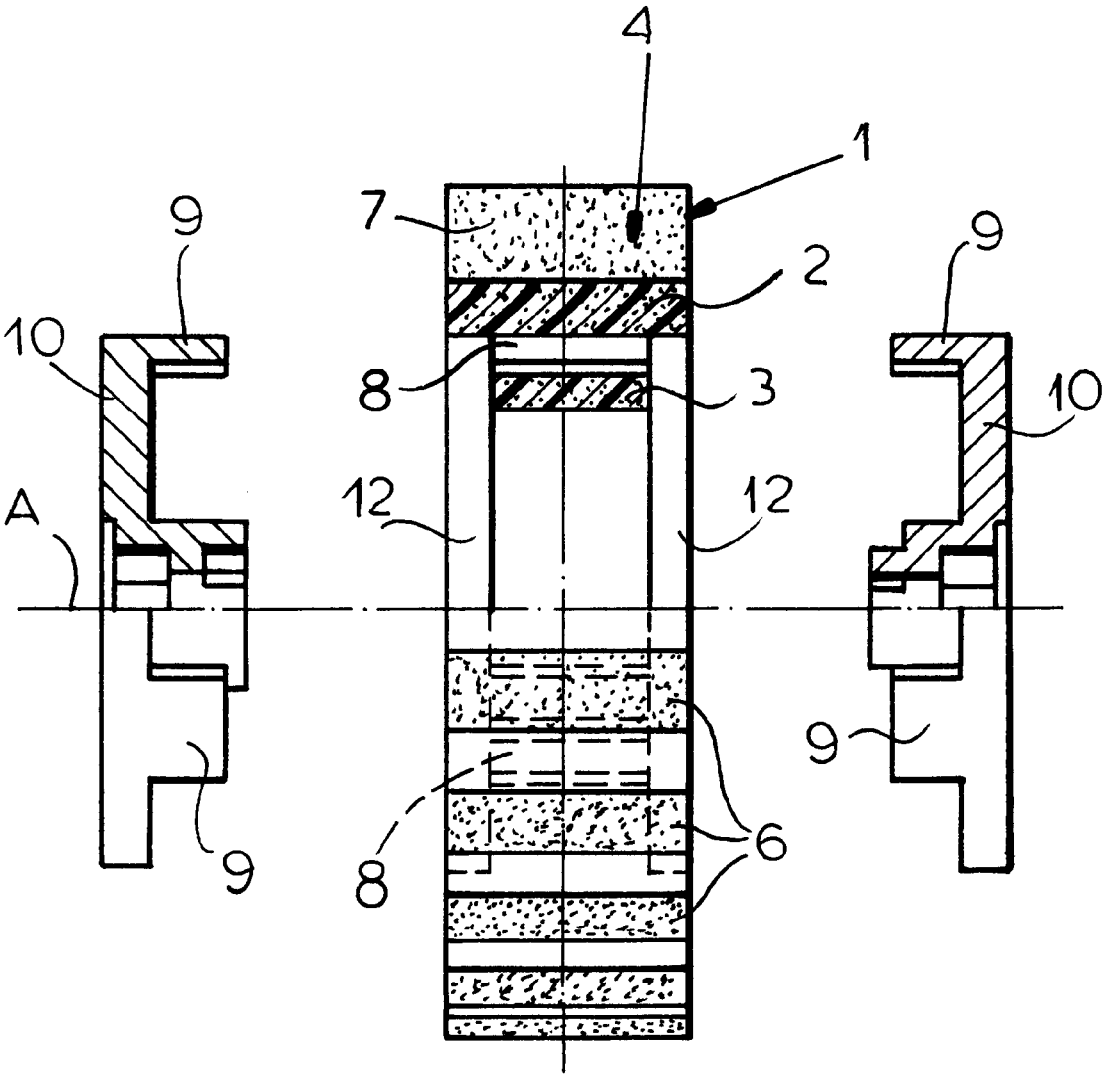
FIG. 4 is an exploded partial sectional view of the tool.
Figure 5:
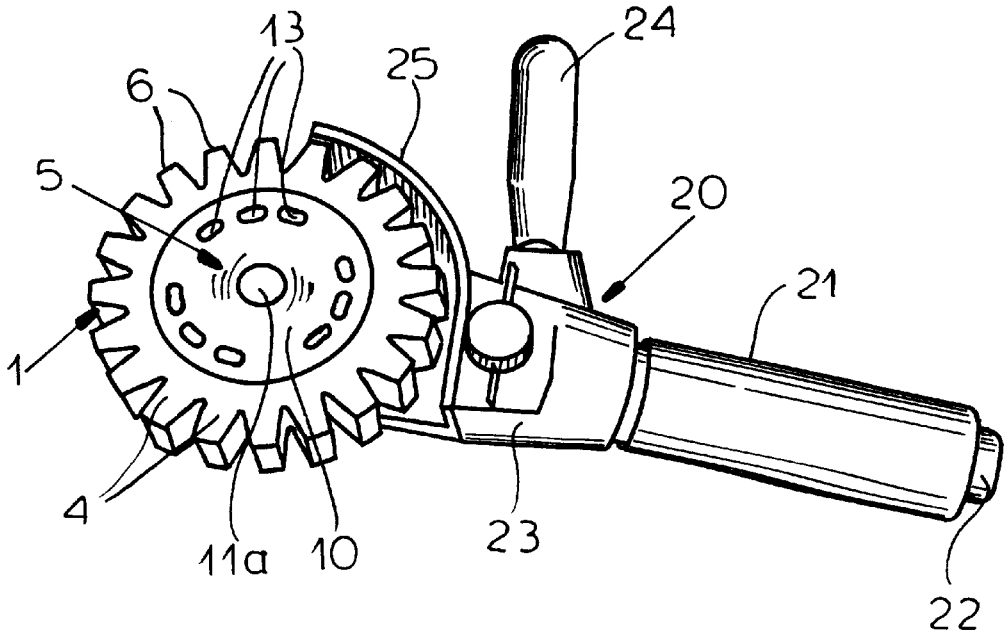
FIG. 5 shows the tool mounted on a compressed-air-driven apparatus.
Figure 8:
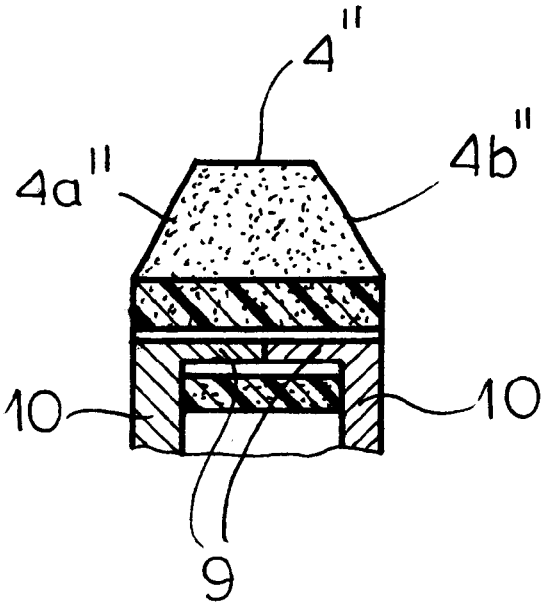
FIG. 8 is a partial section of a further embodiment.

FIG. 8 shows an embodiment in which the teeth 4" are frustopyrimidal with outwardly converging lateral flanks 4*a"* and 4*b"* (compare FIG. 3).

We claim:

1. A rotary tool for the treatment of a surface, said tool comprising:

an annular disk of an elastomeric material selected from the group which consists of rubber and synthetic resins having an outer crown and an inner crown, said outer crown having an annular array of outwardly projecting elastically bendable teeth adapted to abrade material from said surface said teeth being of outwardly tapering frustoconical shape and having outer ends lying along a circular arc, said inner crown having a plurality of inwardly projecting formations; and a rotatable disk holder engaging said formations for rotatable entraining said disk, said formations being angularly equispaced about an axis of rotation of the tool and including axially extending passages receiving axial ribs of said holder, said holder comprising a pair of star-shaped members with axial projections forming said ribs and extending from axially opposite sides into said passages, said star-shaped members forming a socket for a drive shaft.

2. The rotary tool defined in claim 1 wherein abrasive particles are embedded at least in peripheral surfaces of the teeth of said disk.

3. The rotary tool defined in claim 2 wherein the abrasive particles are embedded throughout said teeth.

4. The rotary tool defined in claim 3 wherein the abrasive particles are embedded throughout said outer crown.

5. The rotary tool defined in claim 4 wherein said inner crown has said particles embedded therein.

6. The rotary tool defined in claim 1 wherein at least peripheral surfaces of the teeth of said disk have a coating of an emulsion containing abrasive particles.

7. The rotary tool defined in claim 6 wherein the teeth have coating of said emulsion over their entire areas.

8. The rotary tool defined in claim 7 wherein said outer crown has a coating of said emulsion over an entire area thereof.

9. The rotary tool defined in claim 1 wherein said teeth are provided with particles of an abrasive selected from the group which consists of corundum, silicon carbide, boron carbide, boron nitride and diamond.

10. The rotary tool defined in claim 9 wherein said particles are of a particle size ranging from extra fine to very coarse.

11. The rotary tool defined in claim 1 wherein said outer ends lie along a circular arc.

* * * * *